US005346140A

United States Patent [19]

Campbell

[11] Patent Number: 5,346,140

[45] Date of Patent: Sep. 13, 1994

[54] MOUNTING APPARATUS FOR SPRAY GUNS

[75] Inventor: David H. Campbell, Merseyside, Great Britain

[73] Assignee: Eurotec Surface Coating System Ltd., Wigan, England

[21] Appl. No.: 986,217

[22] Filed: Dec. 7, 1992

[30] Foreign Application Priority Data

Dec. 7, 1991 [GB] United Kingdom ..... 9126033

[51] Int. Cl.[5] ..... B05B 15/08

[52] U.S. Cl. ..... 239/750; 239/752; 239/243; 239/264; 239/536

[58] Field of Search ..... 239/750, 752, 753, 227, 239/243, 263.1, 264, 265, 536

[56] References Cited

U.S. PATENT DOCUMENTS 497,763 5/1893 Campbell ..... 239/264 X
2,365,755 12/1944 Griffith ..... 239/536 X
2,369,950 2/1945 Daly ..... 239/265
2,554,702 5/1951 Heuser ..... 239/227
2,574,206 11/1951 Browning ..... 239/227 X
2,610,088 9/1952 Randell ..... 239/227 X
4,231,239 11/1980 Lazaroff ..... 239/243 X
4,541,565 9/1985 Deimerly et al. ..... 239/752 X
4,762,013 8/1988 Peter et al. ..... 239/243 X

FOREIGN PATENT DOCUMENTS 1500703 2/1978 United Kingdom .

*Primary Examiner*—Andres Kashnikow
*Assistant Examiner*—William Grant
*Attorney, Agent, or Firm*—Seidel, Gonda, Lavorgna & Monaco

[57] ABSTRACT

A spray gun mounting apparatus having a first reciprocal member and second and third spaced fixed members, whereby spray guns or attachment arms for spray guns may be selectably attached to two of the members.

12 Claims, 3 Drawing Sheets

MOUNTING APPARATUS FOR SPRAY GUNS

This invention concerns mounting apparatus for spray guns, particularly spray guns for liquid or powder deposition onto a substrate.

A spray gun mounting apparatus is known which comprises a pair of spaced vertical poles, one fixed and the other arranged to move reciprocally in a vertical plane relative to the fixed pole. Spray guns are coupled to the fixed pole by a pivotting coupler and to the moving pole by a pivotting coupler which allows a spray gun to slide backwards and forwards in the coupler. Then as the movable pole reciprocates the spray guns can spray over an arcuate path determined by the range of movement of the reciprocating pole as an item to be sprayed is moved past the apparatus on a conveyor. Thus, that apparatus is limited in use because the spray guns all move together and over the same range. For spraying some items it would be advantageous to have a variety of spray gun movements, so that coverage of the item may be more even.

An object of this invention is to provide an improved spray gun mounting apparatus. According to this invention there is provided spray gun mounting apparatus comprising a first reciprocal member and second and third spaced fixed members, whereby spray guns or attachment arms therefor may be selectively attached to two of said members.

The first member is preferably arranged for reciprocal movement in a vertical plane. The extent of movement of the first member is preferably variable. The second and third members are spaced from the first member and from each other and are preferably in line. The spacing between one or both of the second and third members and the first member may also be variable.

The apparatus of this invention allows spray guns or attachment arms therefor to be coupled to the various members to provide different types and ranges of movement for the spray guns. Coupling means of known type may be used that allow for pivotting movement and/or sliding movement of the spray guns or attachment arms therefor.

By coupling a spray gun or an attachment arm therefor to the first and third members, a limited range of arcuate movement may be obtained but by coupling instead to the first and the second or intermediate member a greater range of arcuate movement may be obtained. By coupling to the second and third members obviously a fixed spray gun is obtained but by coupling to the first member only, rectilinear reciprocal movement is obtainable for a spray gun.

The various members may be mounted on a base, preferably with wheels for manoeuvrability, which preferably contains or carries motor means for providing said reciprocal movement. The motor is preferably connected to the first member via a linkage that permits adjustment of the range of reciprocal movement. In a preferred embodiment the first member is pivotally connected at one end to a pivotable lever, which lever is pivotally connected to an arm, and the arm is pivotally connected to an eccentric rotated by a motor. The position of connection of the arm to the eccentric is adjustable so as to increase or decrease the throw thereof and hence the range of movement of the first member.

The type or types of spray gun or spray gun attachment arm coupling may be chosen according to the shape and size of the item to be sprayed.

This invention will now be further described, by way of example only, with reference to the accompanying drawings, in which.

Figure 1:
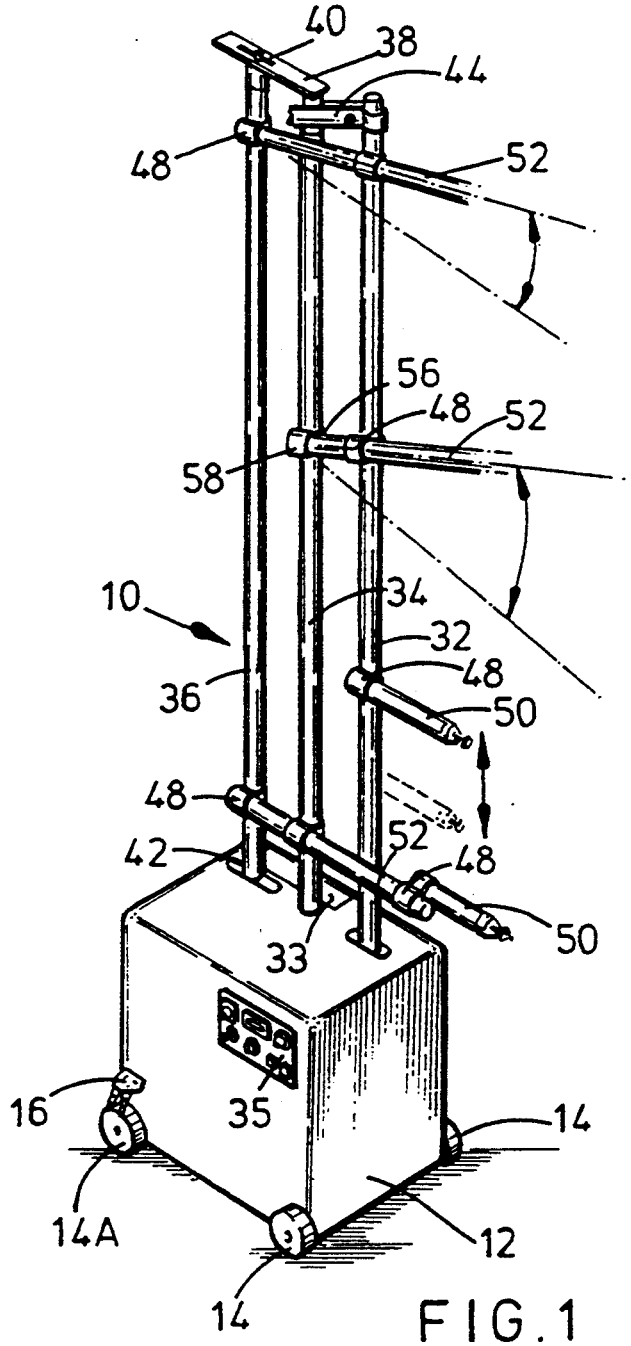
FIG. 1 shows a spray gun mounting apparatus.
Figure 2:
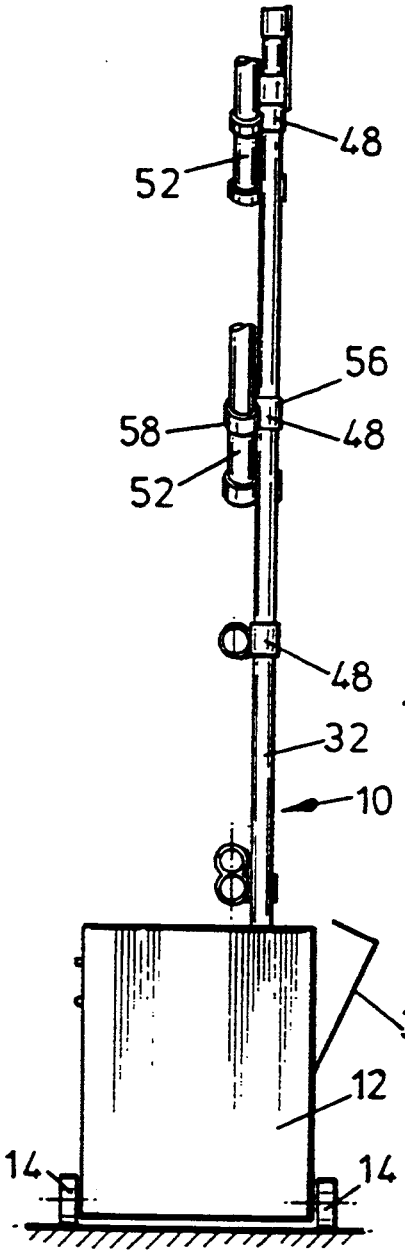
FIG. 2 is a front view of the apparatus of FIG. 1.
Figure 3:
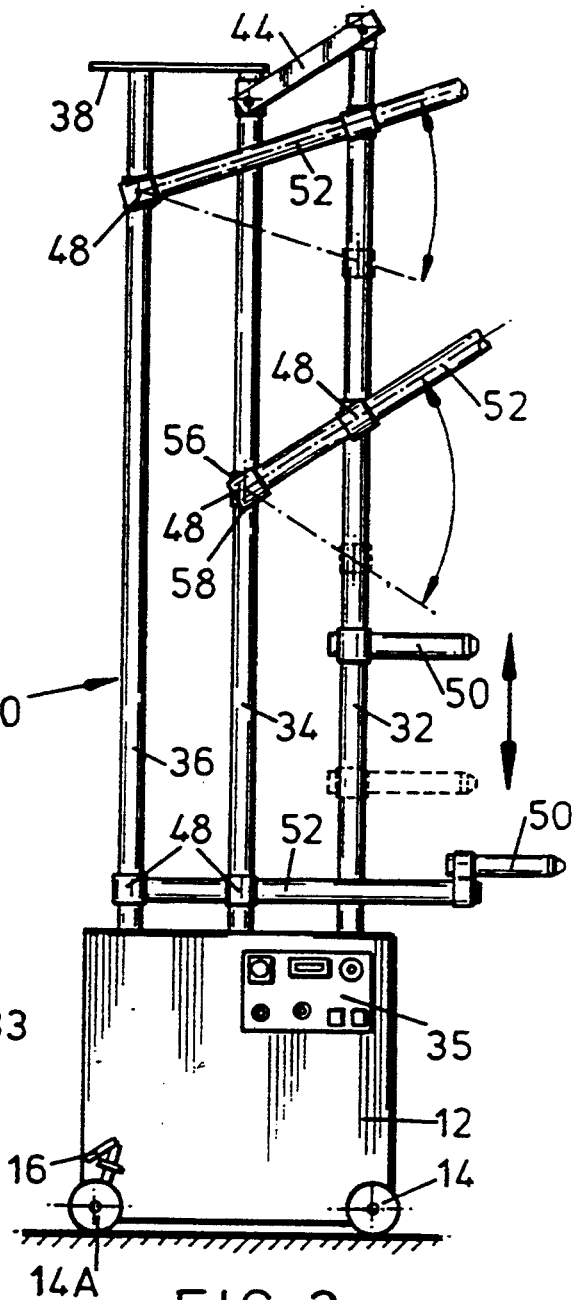
FIG. 3 is a side view of the apparatus of FIG. 1.
Figure 4:
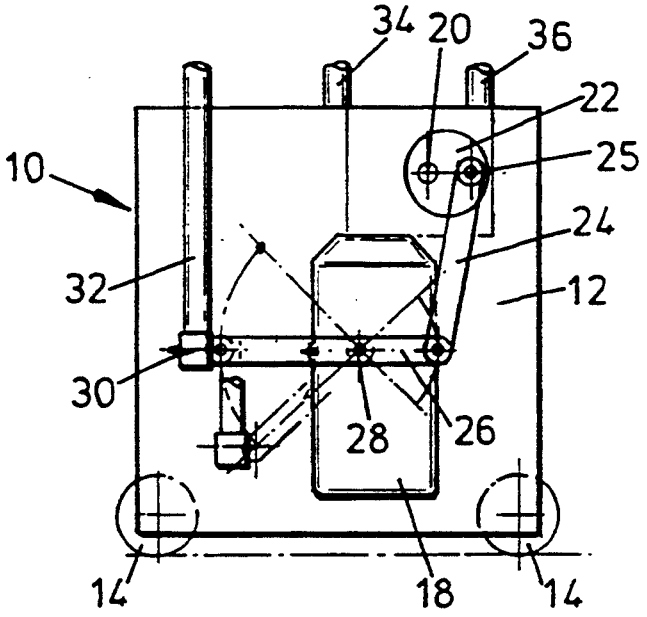
FIG. 4 shows internal detail of the apparatus of FIG. 1.

Referring to the accompanying drawings, spray gun mounting apparatus 10 comprises a base in the form of a box 12 mounted on wheels 14 at each corner, one of the wheels designated 14A having a parking brake mechanism 16 associated therewith. The box 12 contains an electric motor 18 which drives a spindle 20, via suitable gearing (not shown). Mounted eccentrically on the spindle 20 is a disc 22 and the disc carries pivotally a member 24. Pivot point 25 of the member 24 is movable along a diameter of the disc 22 and securable at any desired position along that diameter. Thus, moving the pivot point 25 towards or away from the spindle 20 will decrease or increase the extent of upward or downward movement of the member 24. The other end of the member 24 is pivotally connected to a lever 26 which is pivotally mounted at 28. At its other end the lever is pivotally connected to a coupling 30 to which one end of a first vertical pole 32 is fixed. Thus, as the disc 22 rotates the lever 26 pivots about 28, via the member 24, to raise and lower the vertical pole 32 along an arcuate path as indicated in FIG. 4 of the drawings. The box 12 has a hinged access panel 33 giving access for adjustment of the pivot point 25 of the member 24 on the disc 22. A control panel for the motor is shown at 35.

The box 12 has two further vertical poles 34 and 36 mounted on its top in line with each other and the first pole 32. The second pole 34 is fixed and the third pole 36 is fixed against movement in a vertical plane but is movable in a horizontal plane towards and away from the second pole. The second and third poles are linked by a top bar 38, which has a slot 40 therein to allow for said movement of the third pole as does the box 12 at 42. The first and second poles are linked at their tops by a bar 44, which is pivotally coupled to each pole.

The poles 32, 34 and 36 are circular in section and can carry couplings 48 for attachment of paint spray guns 50 of known type directly or via arms 52. As shown in the drawings the spray guns 50 are attachable to the apparatus in a variety of ways in order to obtain different effects. The couplings 48 have a tubular part 56 which is fixable to a pole and have a pivotable tubular part 58 attached thereto, the part 58 either being fixed to a spray gun 50 or an arm 52 or being unfixed allowing the spray gun 50 or arm 52 to slide backwards and forwards therethrough.

A first effect is achieved by having an arm 52 coupled to the first and third poles 32, 36 with a spray gun fixed to the free end of the arm 52. That gives a limited range of arcuate movement of the spray gun on arm 52 in a vertical plane, say over 45° relative to its fixed pivot point on the pole 36. A second effect is achieved by having an arm 52 coupled to the first and second poles 32, 24 in the same way as the first effect. That gives a greater range of arcuate movement of the spray gun, say over 90°, in the vertical plane. A third effect may be achieved by coupling a spray gun 52 directly to the first pole 32. Then a range of movement in a vertical plane but linear rather than arcuate for the spray gun is possible. Finally an arm 52 may be fixed to the second and third poles for a static spray gun 50 at its free end.

In addition to the above effects, it is possible to adjust the range of movement of the movable spray guns in various ways. As has already been described, the extent of upwards and downwards movement of the first pole is adjustable by altering the pivot point for the member 24 on the eccentric disc 22. Furthermore, the distance of the third pole from the first pole is adjustable to that by being closer together a spray gun on an arm coupled to the first and third poles will have a greater degree of arcuate movement that if the two poles are further apart. Finally, the speed of the electric motor may be increased or decreased.

Thus, the apparatus illustrated can accommodate a variety of spray gun positions and movements which may be selected according to the item to be sprayed.

I claim:

1. A spray gun apparatus comprising a first reciprocal member and second and third spaced fixed members, the first, second and third members being parallel to each other, a first spray gun mounted to said first and second members and a second spray gun mounted to said first and third members, and means for causing reciprocal movement of said first member and corresponding arcuate movement of said first and second spray guns, whereby the first and second spray guns have different ranges of arcuate movement due to their mounting.

2. The apparatus of claim 1, wherein the first member is arranged for reciprocal movement in a vertical plane.

3. The apparatus of claim 1, wherein the extend of movement of the first member is variable.

4. The apparatus of claim 1, wherein the spacing between the second member and the first member is variable.

5. The apparatus of claim 1, wherein the spacing between the third member and the first member is variable.

6. The apparatus of claim 1, wherein the members are mounted on a base having wheels for maneuverability.

7. The apparatus of claim 1, comprising motor means for providing said reciprocal movement.

8. The apparatus of claim 7, wherein the motor means is connected to the first member by a linkage permitting variation of the range of reciprocal movement.

9. The apparatus of claim 8, wherein the first member is pivotally connected at one end to a pivotable lever, which lever is pivotally connected to an arm and the arm is pivotally connected to an eccentric rotated by the motor means, the position of connection of the arm to the eccentric being variable.

10. A spray gun mounting apparatus comprising a base supporting a first member arranged for reciprocal movement in a vertical plane and second and third fixed members laterally spaced from each other and from the first member, a spray gun coupled to the first and second members for a first extent of arcuate movement and a spray gun coupled to the first and third members for a second different, extent of arcuate movement, said arcuate movements being in response to the reciprocal movement of the first member.

11. The spray gun apparatus of claim 10, having a spray gun coupled to the second and third members.

12. The spray gun apparatus of claim 10, having a spray gun coupled to the first member only.

* * * * *